US010234811B2

(12) United States Patent
Hashizume et al.

(10) Patent No.: US 10,234,811 B2
(45) Date of Patent: Mar. 19, 2019

(54) POST-PROCESSING DEVICE AND IMAGE FORMING SYSTEM

(71) Applicant: Konica Minolta, Inc., Tokyo (JP)

(72) Inventors: Masaharu Hashizume, Aichi (JP); Ryouta Shibayama, Aichi (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/361,584

(22) Filed: Nov. 28, 2016

(65) Prior Publication Data

US 2017/0153592 A1 Jun. 1, 2017

(30) Foreign Application Priority Data

Nov. 30, 2015 (JP) ..... 2015-233130
Nov. 14, 2016 (JP) ..... 2016-221728

(51) Int. Cl.
*G03G 15/00* (2006.01)

(52) U.S. Cl.
CPC ..... *G03G 15/6582* (2013.01); *G03G 15/55* (2013.01)

(58) Field of Classification Search
CPC ..... G03G 15/6582; G03G 15/6541; G03G 15/6538; G03G 15/65
See application file for complete search history.

(56) References Cited

U.S. PATENT DOCUMENTS 4,426,785 A * 1/1984 Loftus ..... G01B 7/34 271/12
4,571,055 A * 2/1986 Nishiyama ..... B65H 7/14 271/258.01
5,649,776 A * 7/1997 Sugimoto ..... B41J 15/005 400/617
2010/0007084 A1* 1/2010 Iguchi ..... B65H 35/00 271/264
2010/0066005 A1* 3/2010 Ueda ..... B65H 31/02 271/3.17
2010/0238253 A1* 9/2010 Inoue ..... B65H 7/14 347/218

FOREIGN PATENT DOCUMENTS

JP 2007-137667 A 6/2007

* cited by examiner

*Primary Examiner* — David H Banh
(74) *Attorney, Agent, or Firm* — Osha Liang LLP

(57) ABSTRACT

A post-processing device includes a sheet conveyer that conveys a sheet along a first direction and a sheet end detection sensor that is movable along a second direction orthogonal to the first direction and that detects an end of the sheet in the second direction, wherein the second direction is a sheet width direction. The post-processing device further includes a control unit that: causes the hole puncher to move along the second direction based on a position of the end of the sheet detected by the sheet end detection sensor, adjusts a sensitivity of the sheet end detection sensor, determines, prior to adjusting the sensitivity, whether the sheet still remains at the hole puncher based on levels of output signals from the sheet end detection sensor, and outputs, upon determining that the sheet still remains at the hole puncher, a warning signal.

11 Claims, 6 Drawing Sheets

Table

| Sheet end detection sensor | Length of target sheet along CD direction | Examples of sheets |
|---|---|---|
| PS1 | 139-195 mm | A5 portrait, B5 portrait |
| PS2 | 203-220 mm | A4 portrait, letter portrait |
| PS3 | 257-270 mm | B4 portrait, B5 landscape |
| PS4 | 279-280 mm | 11×17 portrait, letter landscape |
| PS5 | 297-300 mm | A3 portrait, A4 landscape |

POST-PROCESSING DEVICE AND IMAGE FORMING SYSTEM

This application is based on an application No. 2015-233130 and an application No. 2016-221728 filed in Japan, the contents of which are hereby incorporated by reference.

BACKGROUND OF THE INVENTION (1) Field of the Invention

The present invention relates to a post-processing device, particularly to a post-processing device that punches a hole in a sheet on which an image is formed by a printer, a copying machine, or the like and an image forming system including a combination of an image forming device and the post-processing device.

(2) Description of the Related Art

A post-processing device executing processing such as punching of holes in a sheet by using punching rods and stapling sheets by using a stapler is configured to receive sheets on which images are formed and which are successively fed from an image forming device such as a printer and a copying machine. When denoting a center of a sheet along a sheet width direction (hereinafter referred to as a "CD direction") orthogonal to the conveyance direction as a "sheet center" and a center of a sheet conveyance path along the CD direction of the post-processing device as a "sheet conveyance center", the sheet center of a sheet that is fed to a post-processing device from an image forming device sometimes is to some extent shifted from the sheet conveyance center, although the sheet center is supposed to pass the sheet conveyance center during post-processing. When a hole puncher of the post-processing device punches holes in a sheet whose sheet center is shifted from the sheet conveyance center, the holes inevitably are not axisymmetric with respect to the sheet center.

In view of this, in conventional post-processing devices, a shift of the sheet center from the sheet conveyance center along the CD direction is detected, the hole puncher is moved so that a center of the hole puncher matches the sheet center, and hole-punching is executed. In such a structure, the shift of the sheet center from the sheet conveyance center along the CD direction is detected by sheet end detection sensors. Each of the sheet end detection sensors includes a light-emitter and a light-receiver, and a light-emission intensity of the light-emitter is adjusted to a preferable value. In order to adjust the light-emission intensity of the light-emitter, light of various light emission intensities is emitted from the light-emitter and an amount of light reflected on a surface of a mirror facing the sheet end detection sensors is measured. However, when a sheet is remaining at the hole puncher during adjustment of the light emission efficiency of the light-emitter, the light-emission intensity of the light-emitter is adjusted erroneously because an amount of light reflected on the sheet is measured. In conventional post-processing devices, whether or not a sheet remaining at the hole puncher (hereinafter referred to as a remaining sheet) is existent is detected by using sheet sensors disposed upstream in the conveyance direction relative to the hole puncher and downstream in the conveyance direction relative to the hole puncher. The adjustment of the light emission intensity is executed after determination that no remaining sheet is existent at the hole puncher is made by using the sheet sensors.

In recent years, there is a demand for post-processing of sheets in various sizes. Conventional devices configured to achieve such post-processing, however, cannot detect sheets having small sizes remaining between the sheet sensors. However, disposing another sheet sensor for detecting such remaining sheets leads to high cost, and therefore is not desirable.

SUMMARY OF THE INVENTION

One or more embodiments of the present invention provide a post-processing device including a sheet end detection sensor detecting a remaining sheet in addition to detecting an end of a sheet, and an image forming system including a combination of an image forming device and such a post-processing device.

A post-processing device of one or more embodiments includes: a sheet conveyer that conveys a sheet along a first direction; one or more sheet end detection sensors that is movable along a second direction orthogonal to the first direction and that detects an end of the sheet in the second direction, the second direction being a sheet width direction; a hole puncher that is movable along the second direction and punches a hole in the sheet; a controller that causes the hole puncher to move along the second direction based on a position of the end of the sheet detected by the one or more sheet end detection sensors and to punch a hole in the sheet; and a sensitivity adjuster that executes a sensitivity adjustment of adjusting sensitivity of the one or more sheet end detection sensors. In the post-processing device, the controller executes, prior to the sensitivity adjustment, a remaining sheet detection of determining whether or not a sheet is remaining at the hole puncher based on levels of output signals from the one or more sheet end detection sensors, and when a sheet is remaining at the hole puncher, outputs a signal to instruct display of a warning urging removal of the remaining sheet.

In the post-processing device, one or more sheet end detection sensors are used for determining whether or not a sheet is remaining at a hole puncher, as well as for detecting the shift along the CD direction. When a sheet is remaining at the hole puncher, a signal instructing display of a warning urging removal of the remaining sheet is output. For example, display of the warning is executed by a display unit of a control panel that the image forming device includes.

Further, an image forming system of one or more embodiments of the present invention includes: an image forming device; and a post-processing device that executes post-processing of a sheet on which the image forming device has formed an image and which is ejected from the image forming device. In the image forming system, the post-processing device includes: a sheet conveyer that conveys a sheet along a first direction; one or more sheet end detection sensors that is movable along a second direction orthogonal to the first direction and that detects an end of the sheet in the second direction, the second direction being a sheet width direction; a hole puncher that is movable along the second direction and punches a hole in the sheet; a controller that causes the hole puncher to move along the second direction based on a position of the end of the sheet detected by the one or more sheet end detection sensors and to punch a hole in the sheet; and a sensitivity adjuster that executes a sensitivity adjustment of adjusting sensitivity of the one or more sheet end detection sensors. In the post-processing device, the controller executes, prior to the sensitivity adjustment, a remaining sheet detection of determining whether or not a sheet is remaining at the hole puncher based on levels of output signals from the one or more sheet end detection sensors, and when a sheet is remaining at the hole puncher, outputs a signal to instruct display of a warning urging removal of the remaining sheet.

BRIEF DESCRIPTION OF THE DRAWINGS

Advantages and features of the invention will become apparent from the following description thereof taken in conjunction with the accompanying drawings which illustrate one or more embodiments of the invention.

In the drawings.

DETAILED DESCRIPTION OF EMBODIMENTS

The following describes a post-processing device according to one or more embodiments of the present invention, with reference to the drawings. Note that a component/portion that appears in multiple drawings is indicated by using the same reference signs, and when a component/portion has already been described with reference to one drawing, the component/portion is not described once again when appearing in another drawing.

Figure 1:
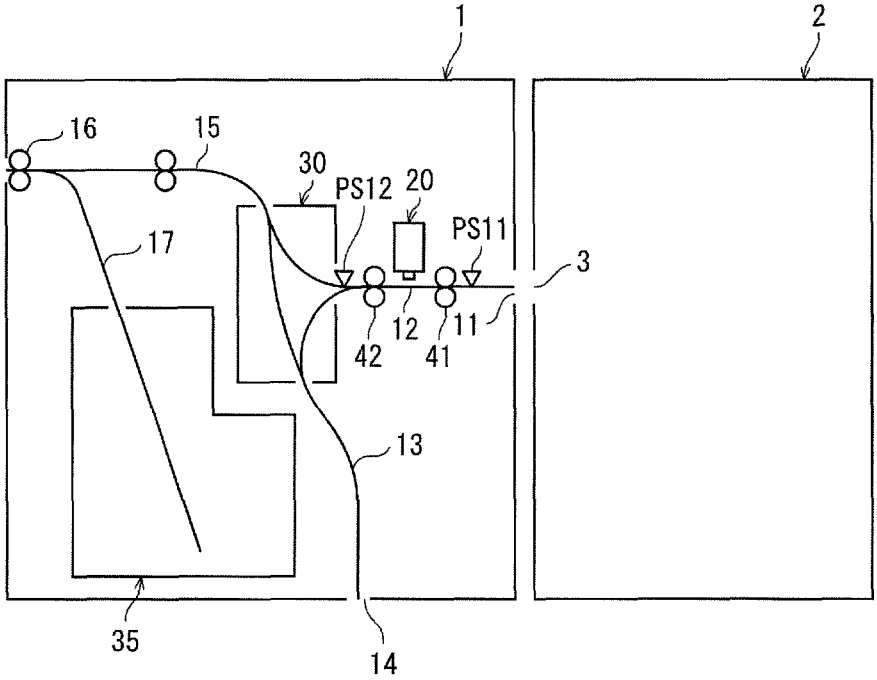
FIG. 1 illustrates an overall structure of a post-processing device according to one or more embodiments of the present invention.

As illustrated in FIG. 1, a post-processing device 1 receives a sheet on which an image is formed. The sheet is ejected from a sheet outlet 3 of an image forming device 2. The post-processing device 1 executes processing selected in advance, such as hole-punching, z-folding, and/or stapling, with respect to the sheet. Specifically, the sheet is received at a sheet inlet 11 of the post-processing device 1, and is hole-punched by a hole puncher 20 while being conveyed along a sheet conveyance path 12. When the sheet undergoes z-folding at a z-folder 30, the sheet is conveyed along a sheet conveyance path 13 and is ejected from a sheet outlet 14. Meanwhile, when the sheet does not undergo z-folding, the sheet is conveyed along a sheet conveyance path 15 and is ejected from a sheet outlet 16. When a sheet bundle is to be stapled, the sheet bundle is first conveyed along a sheet conveyance path 17 to a stapler 35, is then conveyed backwards along the sheet conveyance path 17 after being stapled, and is ejected from the sheet outlet 16.

Note that the post-processing device 1 may be configured to receive sheets that a user manually inserts one by one. The image forming device 2 is a printer, a copying machine, or the like that forms a color image on a sheet. Detailed structures, electrophotographic processes, and the like of such devices are known, and explanation thereof is omitted.

Figure 2:
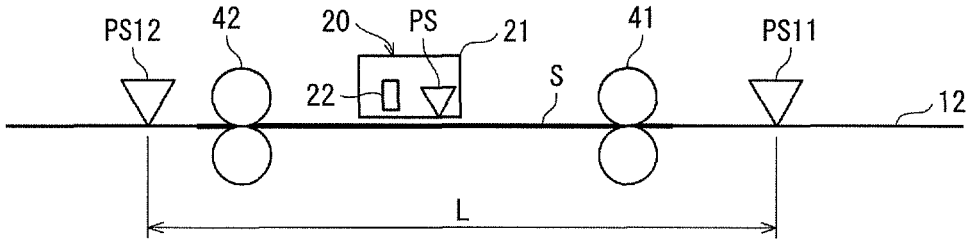
FIG. 2 illustrates a hole puncher and a part of a sheet conveyance path in the proximity of a hole puncher.

As illustrated in FIG. 2, the hole puncher 20 is disposed along the sheet conveyance path 12 between conveyance rollers 41 and conveyance rollers 42. Sheet sensors PS11 and PS12 are disposed along the sheet conveyance path 12 outside the region between the conveyance rollers 41 and the conveyance rollers 42, with the sheet sensor PS11 closer to the conveyance rollers 41 and the sheet sensor PS12 closer to the conveyance rollers 42. A distance L between the sheet sensors PS11 and PS12 is, for example, 170 mm, and is longer than a length of a sheet with a minimum sheet size (A5 portrait). Accordingly, the sheet sensors PS11 and PS12 sometimes fail to detect a sheet S when the sheet S has the minimum sheet size and is remaining at the hole puncher 20.

Figure 4B:
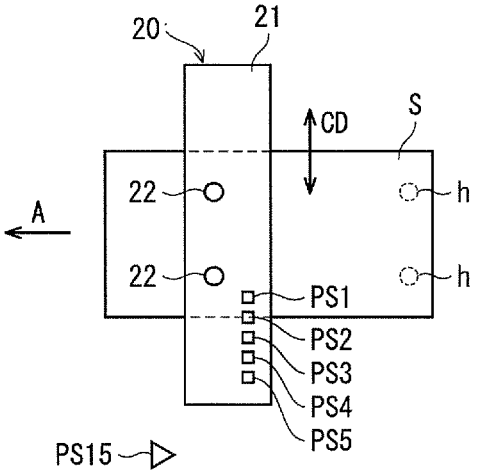
FIG. 4A and FIG. 4B illustrate movement of the hole puncher.

The hole puncher 20 has a housing 21 accommodating two punching rods 22, an actuator driving the punching rods 22 (not illustrated), and sheet end detection sensors PS (PS1 through PS5). The hole puncher 20 also has a moving mechanism that causes the housing 21 to slide along the CD direction (a second direction), which is orthogonal to a conveyance direction. The punching rods 22 punch holes h in a rear end of the sheet S conveyed along the conveyance direction indicated by arrow A (a first direction), as illustrated in FIG. 4B. A midpoint between the punching rods 22 is hereinafter referred to as a "hole puncher center". Meanwhile, the number of the punching rods 22 is not limited to two and can be changed as necessary.

Figure 3A:
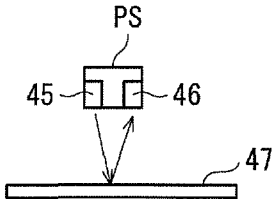
FIG. 3A and FIG. 3B illustrate one of a plurality of sheet end detection sensors.
Figure 3B:
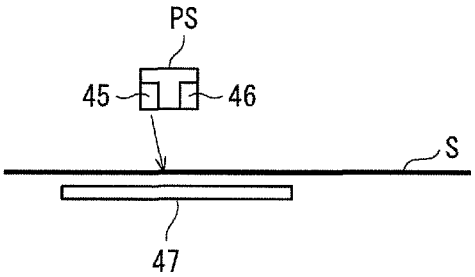

As illustrated in FIG. 3A and FIG. 3B, each of the sheet end detection sensors PS includes a light-emitter 45 and a light-receiver 46 that detects reflected light originally emitted from the light-emitter 45. A mirror 47 is disposed to face the sheet end detection sensors PS, and light from the light-emitter 45 normally is reflected on the mirror 47 and enters the light-receiver 46 (see FIG. 3A). However, when the sheet S is located above the mirror 47 as illustrated in FIG. 3B, light emitted from the light-emitter 45 is scattered by the sheet S and the light-receiver 46 receives a smaller light amount compared to when no sheet is being conveyed above the mirror 47. Accordingly, measuring the light amount received by the light-receiver 46 (reflected light amount) makes detection of the sheet S possible.

Figure 4A:
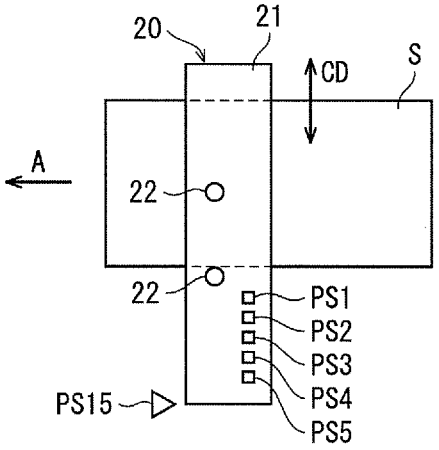
Figure 5:
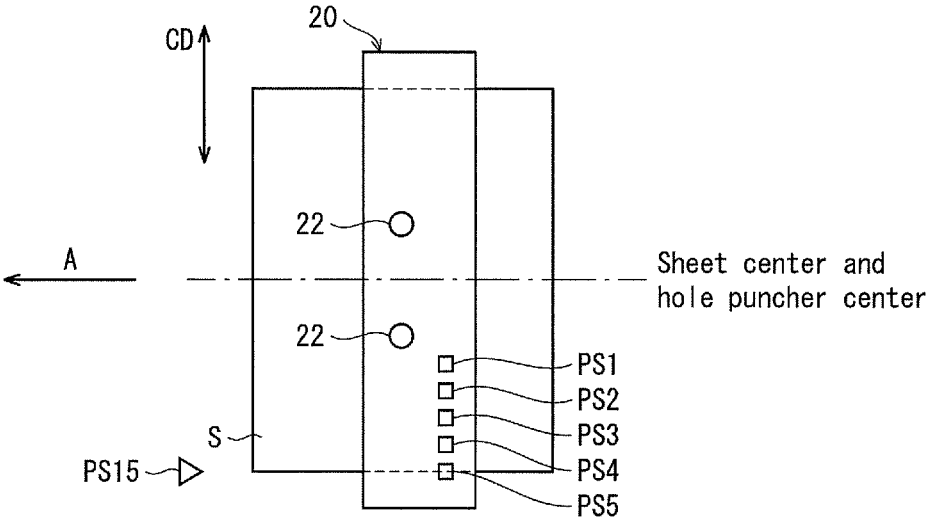
FIG. 5 illustrates sheet end detection by the sheet end detection sensors.

As illustrated in FIG. 4A, FIG. 4B, and FIG. 5, the housing 21, which accommodates the punching rods 22 and the sheet end detection sensors PS, is slidable along the CD direction. The following describes how the sheet S is detected by the sheet end detection sensors PS and how hole-punching is executed.

Figures 6, 7:
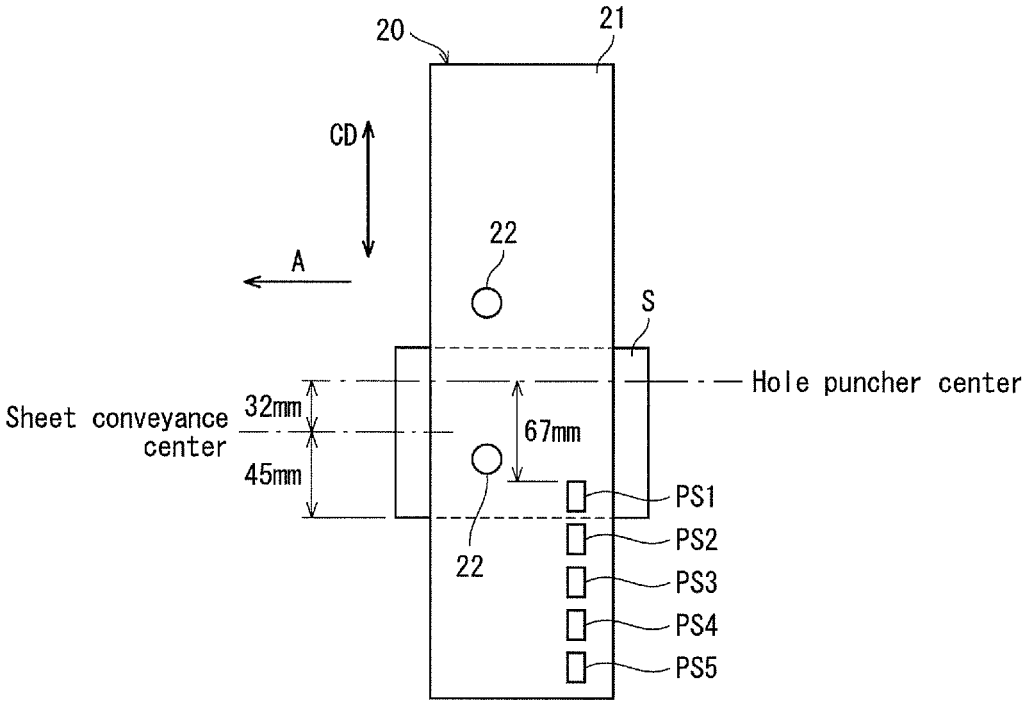
FIG. 6 illustrates remaining sheet detection by the sheet end detection sensors.
FIG. 7 is a table illustrating a target sheet size for each of the sheet end detection sensors.

Sheets of various sizes illustrated in "sheet examples" on the table in FIG. 7 may be fed to the sheet conveyance path 12. The sheet end detection sensors PS1 through PS5 are each configured to detect sheets of one sheet size, as illustrated in the table in FIG. 7. The sheet end detection sensor PS1 is disposed closest to the hole puncher center, the sheet end detection sensor PS2 is disposed the second closest to the hole puncher center, . . . and the sheet end detection sensor PS5 is disposed the least closest to the hole puncher center, as illustrated in FIG. 6. The size of the sheet S ejected from the image forming device 2 is notified to the post-processing device 1 in advance. The sheet S is conveyed from the right to the left in FIG. 4A and FIG. 4B, and the hole puncher 20 is slid along the CD direction during sheet conveyance. The hole puncher 20 stops at a position after moving a predetermined distance along the CD direction from when one of the sheet end detection sensors PS corresponding to the size of the sheet S detects the sheet S. The predetermined distance differs depending upon the size of the sheet S. The hole puncher 20 moves so that the hole puncher center and the sheet center match each other, as illustrated in FIG. 5. Then, the punching rods 22 are actuated at a predetermined time point and punches holes in the rear end of the sheet S.

FIG. 5 illustrates a case where the sheet S has an A4 landscape size, the sheet end detection sensor PS5 has detected the end of the sheet S, and the hole puncher center already matches the sheet center when the end of the sheet S is detected by the sheet end detection sensor PS5. Accordingly, the hole puncher 20 does not have to be moved further along the CD direction for execution of hole-punching.

FIG. 4A illustrates a home position of the hole puncher 20, which is the position of the hole puncher 20 before being slid along the CD direction. Whether or not the hole puncher 20 is at the home position is determined by a home sensor PS15 provided for detection of a predetermined portion of the housing 21 (an end portion of the housing 21 in FIG. 4A).

Figure 8:
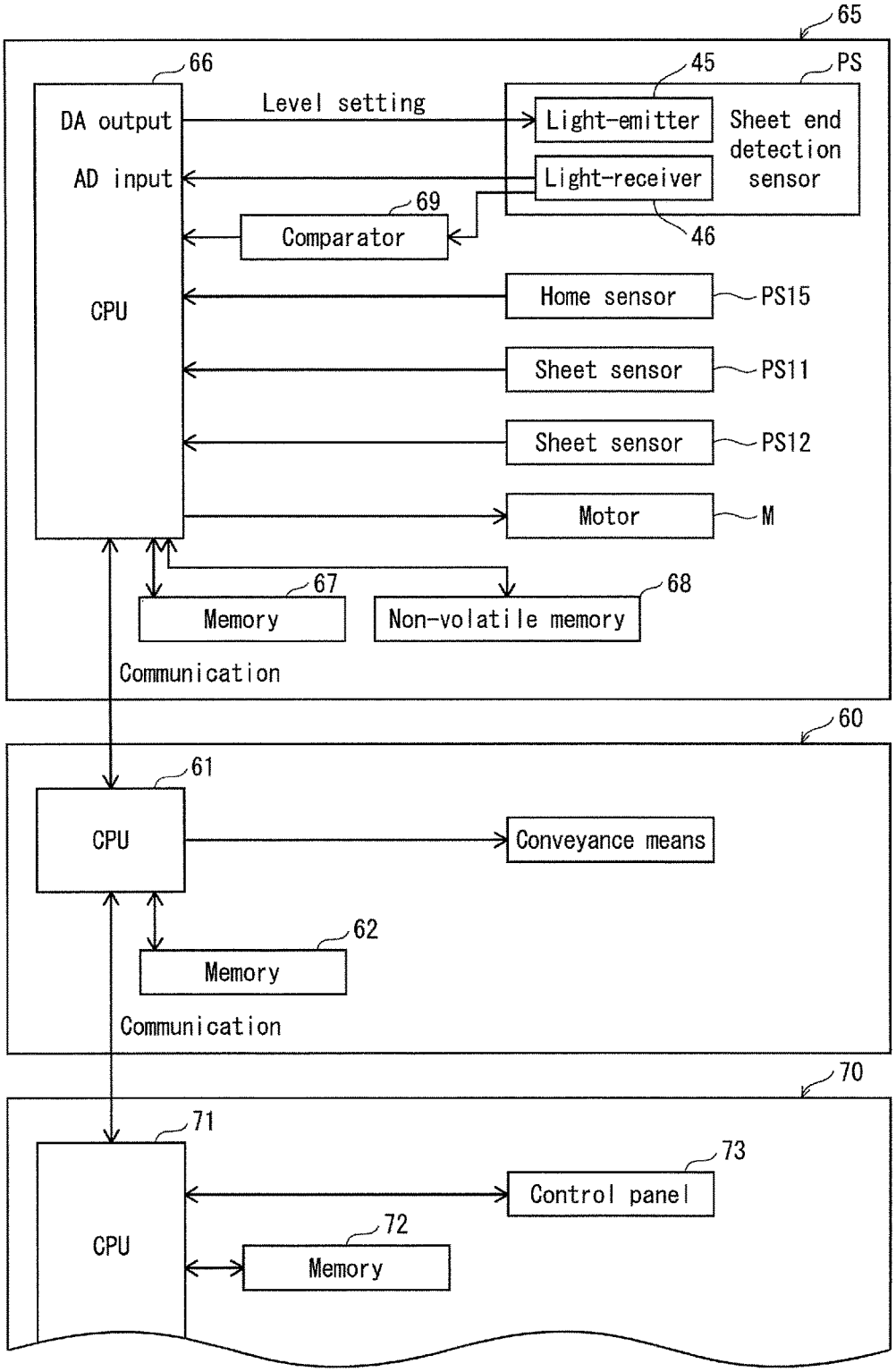
FIG. 8 is a block diagram illustrating a control system.

FIG. 8 illustrates a control system including a controller 60 of the post-processing device 1, a controller 65 of the hole puncher 20, and a controller 70 of the image forming device 2. A CPU 61 of the controller 60, a CPU 66 of the controller 65, and a CPU 71 of the controller 70 can communicate with each other. The CPU 61 includes a memory 62, the CPU 66 includes a memory 67, and the CPU 71 includes a memory 72. The controller 65 further includes a non-volatile memory 68. The controllers may be referred collectively as "control unit."

The CPU 66 outputs signals indicating light emission intensities to the light-emitters 45 of the sheet end detection sensors PS, receives light-reception signals from the light-receivers 46, and converts the light-reception signals to digital signals. The CPU 66 also receives signals that are output from the home sensor PS15 and the sheet sensors PS11 and PS12, and outputs a control signal for controlling a motor M that drives the actuator of the punching rods 22. The CPU 61 controls the z-folder 30, the stapler 35, and conveyance means such as the conveyance rollers 41 and 42. The CPU 71 exchanges necessary information with a control panel 73 that has an input unit and a display unit, and controls known image forming components of the image forming device 2 such as a photoreceptor, an intermediate transfer belt, and a developer that are not illustrated.

The light emission intensities of the light-emitters 45 are adjustable. Further, in order to detect the end of the sheet being conveyed, the sheet end detection sensors PS need to be able to accurately detect the change in light amounts that the light-receivers 46 receive. Accordingly, the sheet end detection sensors PS immediately output analog signals indicating light amounts received by the light-receivers 46 to a comparator 69. The comparator 69 converts each of the analog signals to a binary signal indicating one of High (sheet nonexistent) and Low (sheet existent). The comparator 69 performs this conversion by comparing the analog signals with a fixed voltage. Sensitivity of each of the sheet end detection sensors PS needs to be adjusted so that the binary signal indicates High when no sheet is remaining at the hole puncher 20 and the binary signal indicates Low even upon slight decrease of the light amount that the light-receiver 46 receives due to the presence of a remaining sheet, however thin the sheet may be. Although sensitivity of the sheet end detection sensors PS can be adjusted by changing the voltage that the comparator 69 uses for executing the comparison, one or more embodiments adjust sensitivity of the sheet end detection sensors PS by changing light emission intensities of the light-emitters 45. A process of setting light emission intensities of the sheet end detection sensors PS in order to adjust sensitivity of the sheet end detection sensors PS is hereinafter referred to as "light amount adjustment". The light amount adjustment is executed as necessary because light emission intensities of light-emitters 45 change due to factors such as changes in characteristics of the sheet end detection sensors PS caused by elapse of time and the accumulation of dust, paper powder, or the like on the mirror 47.

In one or more embodiments, the light amount adjustment of the sheet end detection sensors PS is executed at one or more of the following time points: when the post-processing device 1 is turned on, when the post-processing device 1 recovers from the sleep mode which is a resting mode for power-saving, and when a door (not illustrated) provided for maintenance of the post-processing device 1 is opened and then closed. The controller 65 determines whether the door for maintenance is opened or closed on the basis of a signal that is output from a known door opening/closing detection sensor (not illustrated).

Remaining sheet detection for detecting whether or not the sheet is remaining along the sheet conveyance path 12 (the conveyance path at the hole puncher 20) is executed immediately before executing the light amount adjustment. In other words, the CPU 66 executes the light amount adjustment by calculating light emission intensities of the sheet end detection sensors PS for executing the sheet end detection only after confirming that no remaining sheet is existent.

In the remaining sheet detection, each of the light-emitters 45 of the sheet end detection sensors PS emits light of a predetermined intensity. The judgment that a remaining sheet is nonexistent is made when analog levels indicating light amounts received by all of the light-receivers 46 are equal to or greater than a predetermined level. The judgment that a remaining sheet is existent is made when an analog level of the light amount received by at least one of the light-receivers 46 is less than the predetermined level. When a judgment that a remaining sheet is existent is made, a warning signal is output, e.g., a message string "remaining sheet existent" is displayed on the display unit of the control panel 73 of the image forming device 2 so as to urge the user to remove the remaining sheet. When a judgment that a remaining sheet is nonexistent is made, the light amount adjustment is executed.

In the light amount adjustment, the light emission intensity of each of the light-emitters 45 with which the corresponding light-receiver 46 receives a light amount within a predetermined range is determined by gradually increasing the light emission intensity of the light-emitter 45 by a predetermined value from zero (extinguished). Then the light emission intensity so determined is stored. In one or more embodiments, the non-volatile memory 68 of the controller 65 is caused to store, for each of the light-emitters 45, the determined light emission intensity. In cases where the controller 60 or the controller 70 includes a non-volatile memory, the determined light emission intensity may be stored in the non-volatile memory in the controller 60 or 70.

In the remaining sheet detection, the sheet end detection sensors PS are moved to positions enabling detection of the sheet, when remaining along the sheet conveyance path 12 (hereinafter referred to as "remaining sheet detection positions"). That is, the sheet end detection sensors PS are moved to positions such that at least one of the sheet end detection sensors PS is facing the sheet regardless of the size of the remaining sheet (i.e. even when the sheet has the shortest size along the CD direction). For example, in order to enable the sheet end detection sensor PS1 to detect the sheet when the sheet has the shortest size, i.e. a length of 90 mm along the CD direction, the hole puncher 20 is moved so that the hole puncher center is located, toward the back side of the post-processing device (that is, the upper direction in FIG. 6), at a distance of 32 mm from the sheet conveyance center. In this position, the sheet end detection sensor PS1 can detect the remaining sheet even when the remaining sheet has a shortest size along the CD direction. Note that the remaining sheet detection positions of the sheet end detection sensors PS are different from standby positions of the sheet end detection sensors PS (the home position of the hole puncher 20).

Meanwhile, the position of the hole puncher 20 for executing the remaining sheet detection (i.e. the remaining sheet detection positions of the sheet end detection sensors PS) may be determined from the size along the CD direction of a sheet that has been hole-punched immediately before the remaining sheet detection.

Further, when the sheet sensors PS11 and PS12 and the like detect an error such as sheet jam in the post-processing device 1 and none of the sheet end detection sensors PS are at the remaining sheet detection positions, the sheet end detection sensors PS are moved to the remaining sheet detection positions before operations of the post-processing device 1 are terminated. This enables the sheet end detection sensors PS to execute the remaining sheet detection immediately after the sheet jam is resolved.

Further, when the light emission intensities determined when a previous light amount adjustment has been executed are stored the non-volatile memory 68 as described above, the determined light emission intensities stored in the non-volatile memory 68 may be used for a subsequent remaining sheet detection. Meanwhile, when the non-volatile memory 68 has never been caused to store determined light emission intensities, each of the light-emitters 45 may be caused to emit light of a preset intensity (an initial light emission intensity), or the remaining sheet detection may not be executed.

Figure 9:
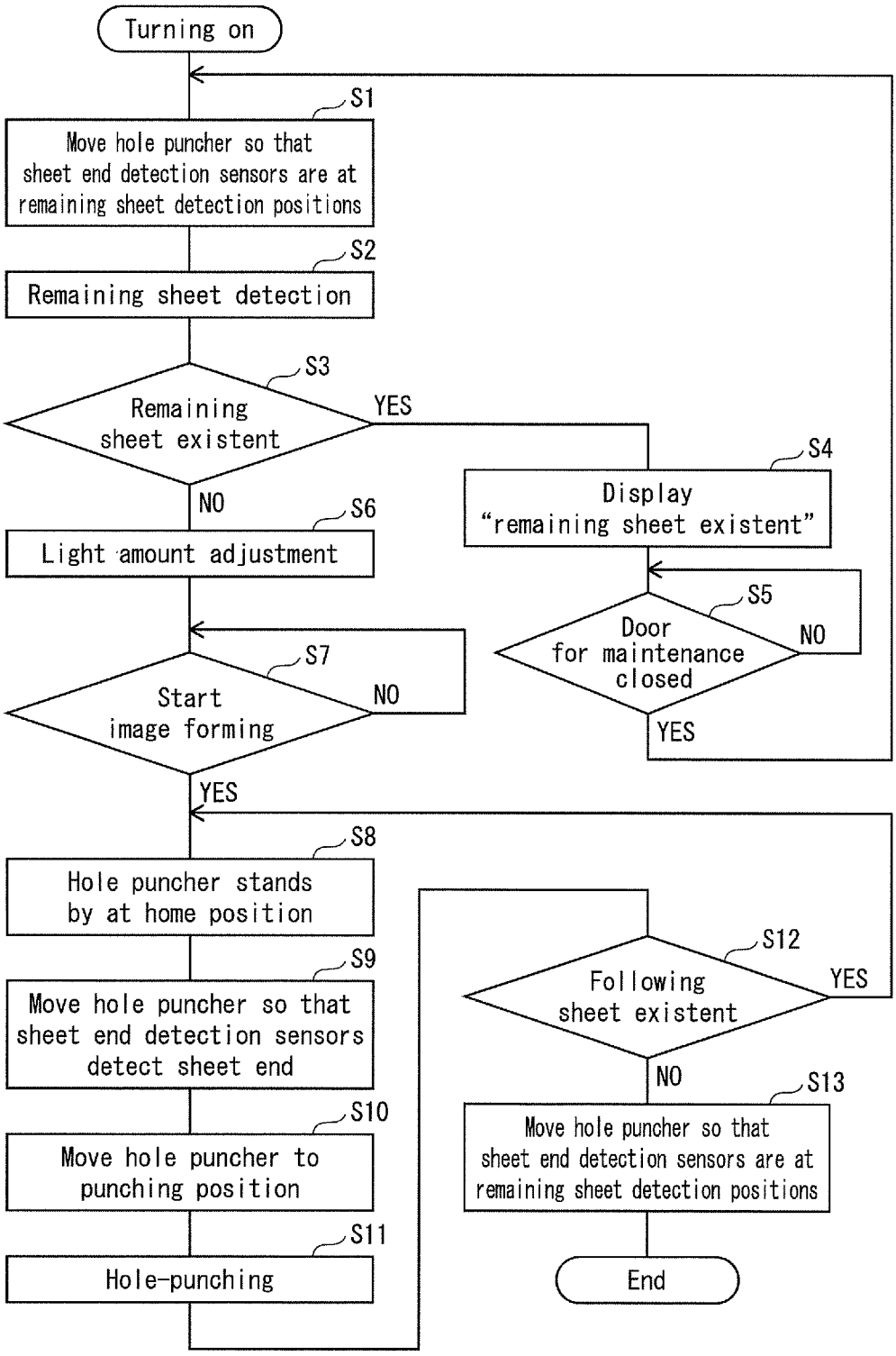
FIG. 9 is a flowchart illustrating control procedures.

The following briefly describes a control procedure for the remaining sheet detection and hole-punching, with reference to FIG. 9. When the post-processing device 1 is turned on along with the image forming device 2, the hole puncher 20 is first moved so that the sheet end detection sensors PS are at the remaining sheet detection positions (see FIG. 6) (step S1), and then the sheet end detection sensor PS1 is used for executing the remaining sheet detection (step S2). When a remaining sheet is existent (YES in step S3), the controller 65 outputs a signal to the controller 70 so that the display unit of the control panel 73 is caused to display a message string "remaining sheet existent" (step S4) to urge the user to remove the remaining sheet. Then, the user opens the door for maintenance of the post-processing device 1 in order to manually remove the remaining sheet. When the front door is closed once again (YES in step S5), the procedure returns to step S1 described above.

When a remaining sheet S is nonexistent (NO in step S3), the controller 65 executes the above-described light amount adjustment of the sheet end detection sensors PS (step S6), and the post-processing device 1 stands by for a start of image forming by the image forming device 2 (step S7). Thus, the controller 65 functions as a sensitivity adjuster of the present invention when executing the light amount adjustment of step S6.

When the image forming starts (YES in step S7), the hole puncher 20 is made to stand by at the home position (step S8). Then, the hole puncher 20 is moved along the CD direction in accordance with conveyance of a sheet, so that one of the sheet end detection sensors PS that corresponds to the size of the sheet detects the end of the sheet (step S9). Further, the hole puncher 20 is moved along the CD direction and is stopped at a position at which the hole puncher center matches the sheet center (step S10). Conveyance of the sheet is stopped for a moment when the rear end of the sheet arrives below the punching rods 22, and holes are punched in the rear end of the sheet (step S11). For example, the conveyance of the sheet is stopped upon passage of a time amount required for the positions in the rear end of the sheet, in which the punching rods 22 are to punch holes, to arrive at the positions of the punching rods 22, after detection of the rear end of the sheet by the sheet end detecting sensor PS11.

When a following sheet exists (YES in step S12), the procedure returns to step S8 described above. When a following sheet does not exist, the hole puncher 20 is moved so that the sheet end detection sensors PS are at the remaining sheet detection positions (step S13).

As described above, a remaining sheet is detected by using the sheet end detection sensors PS in one or more embodiments. This structure excels in cost performance because it is unnecessary to provide an additional sheet sensor.

The post-processing device according to the present invention should not be construed as being limited to the above embodiments, and is able to be modified in various manners within a scope of the gist thereof.

Specifically, the image forming device may have any basic structure, and may execute post-processing other than hole-punching. Further, positional relationships of the sheet end detection sensors can be modified in various manners.

The above embodiments include five sheet end detection sensors PS1 through PS5, but the present invention can be implemented as long as at least one sheet end detection sensor PS (for example, the sheet end detection sensor PS5) is provided. This is because detection of a sheet being conveyed can be achieved by moving the sheet end detection sensor PS5 to a position at which the sheet end detection sensor PS5 can detect the end of the sheet, even when the sheet has the shortest size in the CD direction that the post-processing device can process, and moving the hole puncher 20 along the CD direction from the home position when executing hole-punching.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. A post-processing device comprising:

a sheet conveyer that conveys a sheet along a first direction;

a sheet end detection sensor that:

is movable along a second direction orthogonal to the first direction, and detects an end of the sheet in the second direction, wherein the second direction is a sheet width direction;

a hole puncher that:

is movable along the second direction, and punches a hole in the sheet; and a control unit comprising a plurality of controllers and that:

causes the hole puncher to move along the second direction based on a position of the end of the sheet detected by the sheet end detection sensor, adjusts a sensitivity of the sheet end detection sensor, determines, prior to adjusting the sensitivity, whether the sheet still remains at the hole puncher based on levels of output signals from the sheet end detection sensor, and outputs, upon determining that the sheet still remains at the hole puncher, a warning signal, wherein the control unit refrains from adjusting the sensitivity when the control unit determines that the sheet still remains at the hole puncher.

2. The post-processing device of claim 1, wherein the control unit adjusts the sensitivity during at least one of:

when the post-processing device is turned on;

when the post-processing device recovers from a sleep mode;

and upon closing of a door provided for maintenance of the post-processing device.

3. The post-processing device of claim 1, wherein the sheet end detection sensor comprises a light-emitter and a corresponding light-receiver, light emission intensities of the light-emitter is adjustable, and the light-receiver detects reflected light originally emitted from the corresponding light-emitter.

4. The post-processing device of claim 3, wherein the control unit causes the light-emitter to emit light of a preset intensity and determines that the sheet still remains at the hole puncher when the corresponding light-receiver receives a light amount equal to or smaller than a predetermined value.

5. The post-processing device of claim 3, wherein the control unit:

adjusts the light emission intensities of the light-emitter, and causes a storage to store the adjusted light emission intensities and causes the light-emitter to emit light of the adjusted light emission intensities when subsequently determining whether the sheet still remains at the hole puncher.

6. The post-processing device of claim 5, wherein the storage is a non-volatile memory.

7. The post-processing device of claim 1, wherein the control unit determines whether the sheet still remains at the hole puncher after moving the sheet end detection sensor to a predetermined position.

8. The post-processing device of claim 7, wherein the predetermined position of the sheet end detection sensor is different from a standby position of the sheet end detection sensor, and the standby position is a position for detecting the end of the sheet.

9. The post-processing device of claim 7, wherein the predetermined position of the sheet end detection sensor is a position facing a sheet remaining at the hole puncher that is of a shortest size along the second direction that is conveyable by the post-processing device.

10. The post-processing device of claim 7, wherein when an error occurs in the post-processing device, the control unit terminates operations of the post-processing device, and when the sheet end detection sensor is at the predetermined position upon occurrence of the error, the control unit moves the sheet end detection sensor to the predetermined position before terminating the operations of the post-processing device.

11. An image forming system comprising:

an image forming device; and a post-processing device that executes post-processing of a sheet on which the image forming device has formed an image and which is ejected from the image forming device, wherein the post-processing device comprises:

a sheet conveyer that conveys a sheet along a first direction;

a sheet end detection sensor that:

is movable along a second direction orthogonal to the first direction, and detects an end of the sheet in the second direction, wherein the second direction is a sheet width direction;

a hole puncher that:

is movable along the second direction, and punches a hole in the sheet;

a control unit comprising a plurality of controllers and that:

causes the hole puncher to move along the second direction based on a position of the end of the sheet detected by the sheet end detection sensor, adjusts a sensitivity of the sheet end detection sensor, determines, prior to adjusting the sensitivity, whether the sheet still remains at the hole puncher based on levels of output signals from the sheet end detection sensor, and outputs, upon determining that the sheet still remains at the hole puncher, a warning signal, wherein the control unit refrains from adjusting the sensitivity when the control unit determines that the sheet still remains at the hole puncher.

* * * * *